US005414971A

United States Patent [19]

Handte

[11] Patent Number: 5,414,971

[45] Date of Patent: May 16, 1995

[54] WALL CONSTRUCTION FOR DISPLAY BOOTHS, SALES BOOTHS AND THE LIKE

[75] Inventor: Thomas Handte, Neckartailfingen, Germany

[73] Assignee: F+T Form+Technic Vertriebsgesellschaft, Neckartailfingen, Germany

[21] Appl. No.: 120,661

[22] Filed: Sep. 13, 1993

[30] Foreign Application Priority Data

Sep. 16, 1992 [DE] Germany ..... 42 30 949.2

[51] Int. Cl.[6] ..... E04B 2/56

[52] U.S. Cl. ..... 52/506.06; 52/506.09; 52/782; 52/779; 40/617

[58] Field of Search ..... 52/506.06, 506.08, 506.09, 52/509, 588.1, 235, 775, 778, 779, 762, 763, 782, 731.2; 40/617, 618, 611

[56] References Cited

U.S. PATENT DOCUMENTS

| | | | |
|---|---|---|---|
| 2,862,585 | 12/1958 | McChesney | 52/506.08 |
| 3,150,455 | 9/1964 | Indorf . | |
| 3,251,164 | 5/1966 | Wright | 52/506.09 |
| 3,713,264 | 1/1973 | Morgan, Jr. | 52/506.06 |
| 4,057,967 | 11/1977 | Oide | 52/779 |
| 4,103,465 | 8/1978 | McDonald . | |
| 4,205,496 | 6/1980 | Heirich | 52/779 |
| 4,223,505 | 9/1980 | Krebel et al. | 52/506.06 |
| 4,516,372 | 5/1985 | Osawa | 52/506.09 |
| 5,265,362 | 11/1993 | Yamaguchi | 40/156 |

FOREIGN PATENT DOCUMENTS

| | | | |
|---|---|---|---|
| 512890 | 10/1980 | Australia . | |
| 0358612 | 3/1990 | European Pat. Off. | 52/782 |
| 2624062 | 6/1989 | France . | |
| 1932425 | 10/1970 | Germany | 52/779 |
| 3627583 | 2/1988 | Germany | 52/782 |
| 3831806A1 | 4/1989 | Germany . | |
| 9110357 U | 1/1992 | Germany . | |

OTHER PUBLICATIONS

Product Information "Octanorm" by R. T. Displays Systems Ltd., London SW6 4NZ.

*Primary Examiner*—Carl D. Friedman
*Assistant Examiner*—Winnie Yip
*Attorney, Agent, or Firm*—Frishauf, Holtz, Goodman & Woodward

[57] ABSTRACT

A wall construction for display booths, sales booths and the like has two profiled braces extending parallel and at a distance from each other and have grooves which are engaged from behind in their narrow long sides. At least two support members have been hooked into the lower profiled brace on which a wall panel rests in an upright position. Tilting of the wall panel is prevented by means of an upper retaining member. The support member as well as the retaining member have a U-shaped cross-sectional form, respectively formed by a back part and two legs extending from the back part. One of the legs is inserted into the groove which is engaged from behind of the respective profiled brace, while the other leg engages a groove in the wall panel.

15 Claims, 3 Drawing Sheets

WALL CONSTRUCTION FOR DISPLAY BOOTHS, SALES BOOTHS AND THE LIKE

FIELD OF THE INVENTION

The invention relates to a wall construction for display booths, sales booths and the like, used in such fields as trade show and store construction.

BACKGROUND

In the fields of trade show and store construction it is often necessary to fasten panels to cross braces of the frame for the purpose of separating, with the aid of the walls, individual rooms from each other or to create surfaces on which exhibits or pictures can be hung. For this purpose it is known in actual practice to use a cross brace in the lower area of the wall, which has a protruding, hook-shaped support surface which is of one piece with the profile. A wall panel, for example a particle board, is seated on this support surface which has a groove engaged by the upwardly projecting leg of the section. The panel is prevented from slipping off the support surface by means of a clip which locks in the groove of the upper brace, which is engaged from behind, and engages a corresponding upper groove of the panel with a hook-shaped leg.

With this form of wall fastening it is not possible to use the normal smooth brace which is otherwise employed, which means that a later change is practically impossible once the frame has been erected, i.e. that therefore no additional walls or panels can be used afterwards, unless a brace with a projecting support for the panel has been installed at the beginning for the lower brace. In addition, problems occur in the corner areas, because the projecting support surface would collide with the projecting support of another brace in the corner area unless the braces are are bevel-cut. This, in turn, makes cutting the lengths of the braces considerably more difficult, because it is actually necessary to cut off the brace at exact right angles for connecting it with the column which, as a rule, is octagonal. The additional application of the bevel cut in the area of the support surface represents a considerable difficulty.

The insertion and removal of the upper holding clips is also difficult to accomplish.

THE INVENTION

It is the object of the invention to provide a wall construction for display booths, sales booths and the like which does not require the provision of special cross braces.

This object is attained by means of a wall construction for display booths, sales booths and the like with at least two braces extending parallel and at a distance from each other, each one of which having at least one groove which can be engaged from behind, with a panel fastened to the braces, which extends over the space between the braces and also covers the braces and which contains a groove extending parallel to the respective brace extending in its edge extending parallel to the braces, and with at least one support member, being essentially U-shaped in cross section, for supporting the panel by means of a further brace, and having a back part and two legs extending in the same direction from the back part which extend parallel to each other at least in the longitudinal direction of the support member, and wherein, with the panel secured on the brace, one of the legs engages the groove of the brace, and the other the respective adjoining groove in the edge area of the panel.

The use of a separate support member allows the employment of the otherwise customarily used cross braces, wherein it is possible, if necessary, to suspend two or more support members from the lower cross brace. These can be attached far enough away from the ends of the cross braces so that a collision with the support members of other cross braces extending a right angles is avoided.

In addition, with the novel wall construction for display booths, sales booths or the like, the amount of material used for the lower cross brace is considerably reduced, because the support members need only be provided at a few places and need not extend over the entire length of the cross brace at all, particularly since they practically do not contribute to the stability in the vertical direction. Furthermore, it is afterwards always possible to attach a wall panel at any point with the aid of the support members, in the course of which no interfering parts of the lower brace appear even if the wall panel is considerably narrower than would correspond to the length of the braces supporting it.

Taking up the weight of the wall panel results in the necessity of the support member taking up a torque. This transfer of the torque is accomplished if the leg seated in the groove of the cross brace which is engaged from behind has a hook element, while the same leg is provided with a thrust member outside of the groove. This causes an interlocking transfer of the torque, which considerably reduces the load on the surface. On the other hand, it is possible to remove the support member from the lower brace without additional tools or to displace it along the brace and to bring it to the suitable place.

It is also possible at any time to produce the support member as a section of an appropriately profiled extruded section.

An exemplary embodiment of the subject of the invention is illustrated in the drawings.

DRAWINGS

FIG. 1 is a vertical section, shortened in height, of the novel wall construction for display booths, sales booths and the like, showing the functional position of the lower support member and the upper support member, FIG. 2 shows the lower support member of the wall construction for display booths, sales booths and the like in accordance with FIG. 1 in a lateral view, and FIG. 3 shows the upper support member of the wall construction for display booths, sales booths and the like in accordance with FIG. 1 in a lateral view.

DETAILED DESCRIPTION

Figure 1:
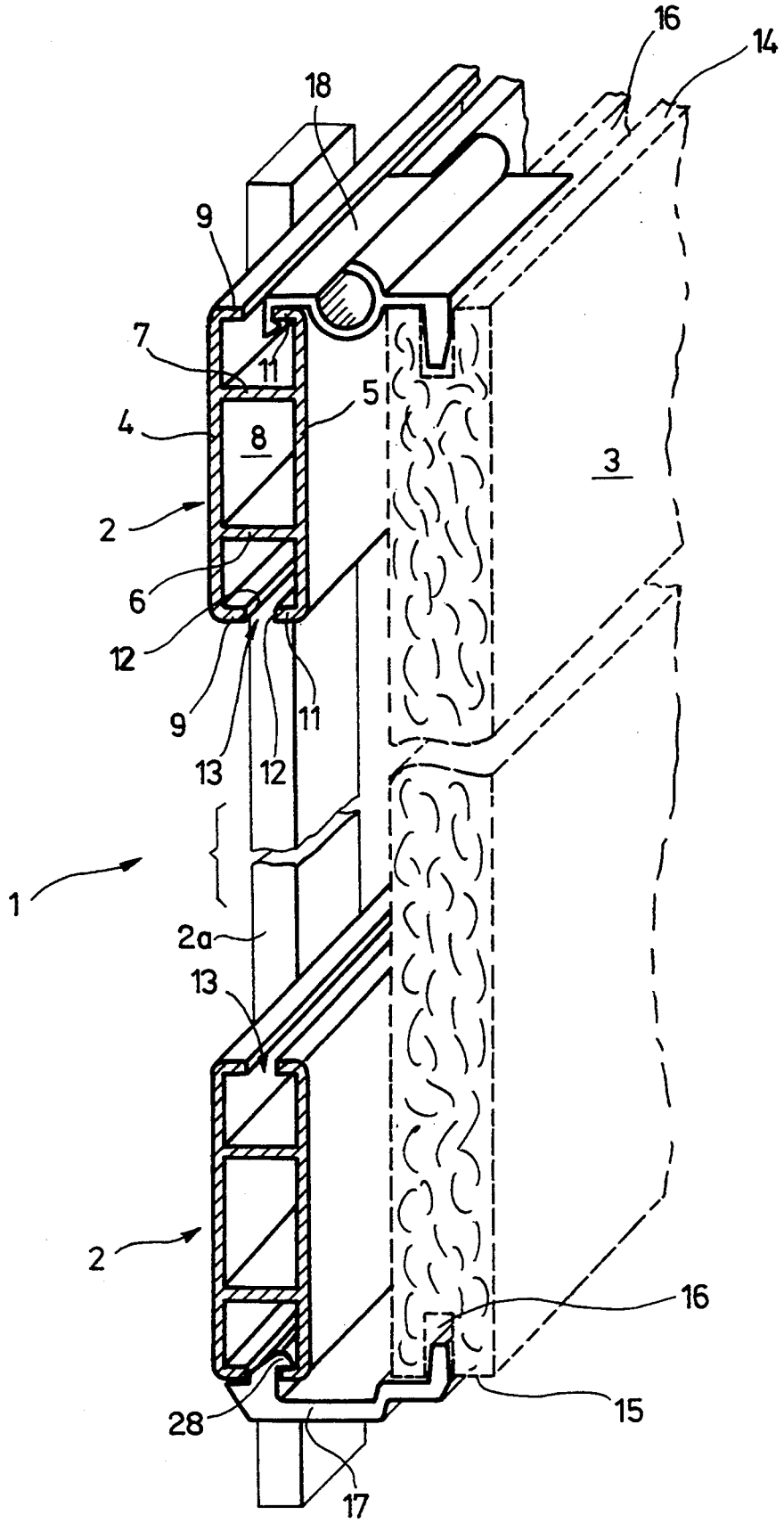

In a vertical section and vertically shortened, FIG. 1 shows a wall construction for display booths or sales booths 1 having two profiled braces 2 extending parallel to each other and spaced from each other, and a wall panel 3 supported by these profiled braces 2, which extends over the space between the two profiled braces 2 and also covers the two profiled braces 2. The two profiled braces 2 are rigidly fastened in a removable manner on vertically extending columns or pillars, schematically shown at 2*a* and are kept in this way at a parallel distance from each other by the columns or pillars. The two profiled braces 2 extend horizontally, as shown in FIG. 1, and have the same cross-sectional shape, for which reason it should be sufficient to describe only one of the two braces in what follows.

The profiled brace 2 consists of an aluminum profiled extruded section having two side walls 4 and 5 extending parallel to each other over the entire length of the brace. These two side walls 4 and 5 are connected in one piece with each other by transverse walls 6 and 7 extending at right angles to the side walls 4 and 5. These two transverse walls 6 and 7 extend at a distance from the upper or lower edge of the two side walls 4 and 5 so that the result is a pipe-shaped hollow chamber 8, rectangular in cross section, located approximately in the center of the profiled brace 2.

Strips 9 and 11 are formed of one piece with the respectively upper and the lower edges of the two side walls 4 and 5 and are disposed parallel and at a distance from the transverse walls 6 and 7. These strips 9 and 11 also extend over the entire length of the cross brace 2, and their free ends, located away from the side walls 4 or 5, are also located at a distance opposite each other. These free ends form interned groove edges 12 of a groove 13 which can be engaged from behind the edges and are bounded at their bottom by the transverse walls 6 or 7, by the insides of the two side walls 4 and 5 and the insides of the strips 9 and 11. Thus, the grooves 13 which are engaged from behind the edges have the shape of T-grooves, wherein the wall thickness in the area of the groove edges 12 is comparatively thin compared with the clear space of the groove 13 which is engaged from behind the edges.

It can be seen from the illustration that the cross section of the profiled braces 2 is symmetrical in respect to the vertical axis as well as the transverse axis.

The two profiled braces 2 are used as the frame for the wall panel 3, which for example is a coated particle board of a thickness of 16 mm. Thus the wall panel 3 is a plane-parallel rectangular panel provided along its upper narrow edge as well as along its lower narrow edge 14, 15 with respectively one smooth-walled groove 16, extending parallel in relation to the respective adjoining profiled brace 2 and rectangular in cross section. The vertical height of the panel 3 corresponds to the distance between the underside of the lower profiled brace 2 and the upper edge of the upper profiled brace 2. For fastening the panel 3 on the profiled braces 2 forming the frame, at least two support members 17 are provided along the lower profiled brace 2, only one of which can be seen for reasons of illustration. These support members 17 support the panel 3 in the vertical direction and transfer the weight of the panel 3 to the lower profiled brace 2.

At least one retaining member 18, hooked from the upper profiled brace 2 and transmitting the tilting moment of the panel 3 in respect to the lower support member 17 into the upper profiled brace 2, prevents the tilting down of the panel 3 from the lower support members 17.

Figure 2:
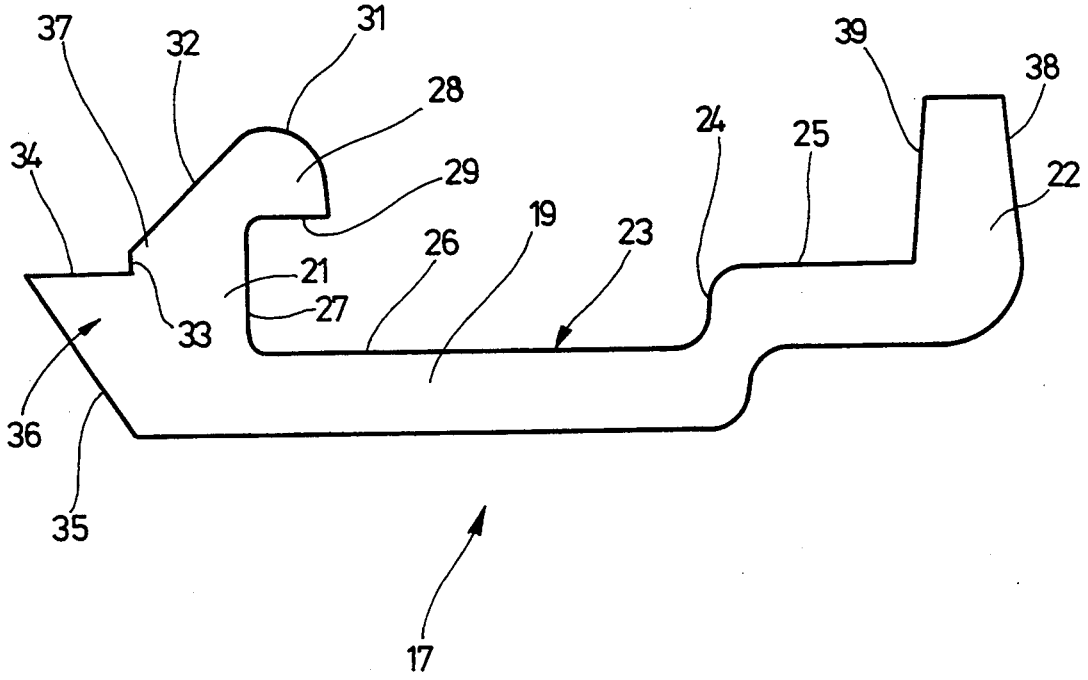
Figure 3:
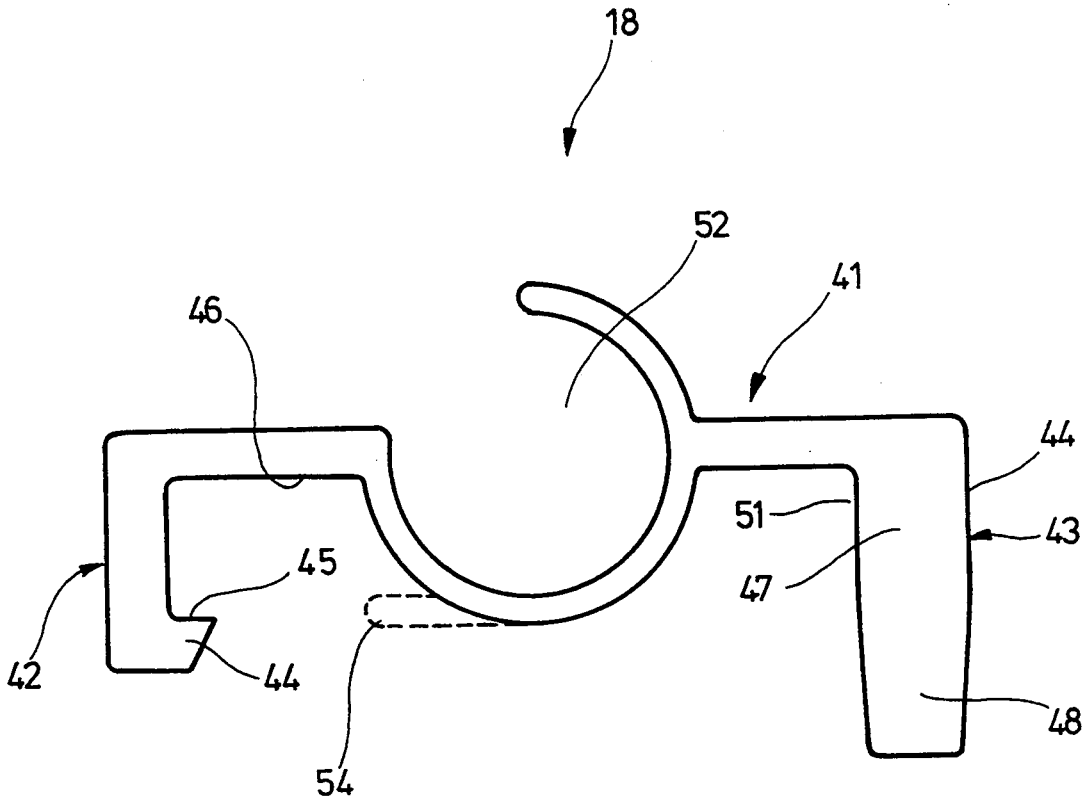

The shape of the support members 17 or of the retaining member(s) 18 is explained in detail in FIGS. 2 and 3, which show a lateral view in the direction parallel to the long axes of the profiled braces 2.

The support member 17 essentially has a U-shaped form, consisting of a back part 19 and two legs 21 and 22 rising in the same direction from the back part 19. The support member 17 is a 5 to 10 cm long section of an extruded profile, having the same cross-sectional form overall.

The back part 19 has an inner surface 23 divided into two sections 25 and 26 by a step or shoulder 24. Both sections 25 and 26 are flat surfaces, however the section 25 of the inside 23 is offset in respect to the section 26 in the direction in which the two legs 21 and 22 point. On its outside, the outer contour of the back part 19 essentially follows the course of the inside 23, so that the back part 19 has approximately the same wall thickness overall.

The leg 21 rises at a distance from the shoulder 24 extending in the long direction of the support member 17 and is bounded by a wall 27 extending parallel to the step 24 and at right angles to the surface section 26. At a distance from the wall 26, the wall 27 makes a transition into a projection 28 which points in the direction toward the leg 22. This projection 28 is bounded on its side facing the inside 23 of the back part 19 by a wall 29 parallel to this which, at its free end, makes a transition into a wall 31 curved in an arc shape. After a length of approximately a quarter of an arc, a flat inclined surface 32 adjoins the wall 31, which is located at the outside of the leg 21 and returns in the direction towards the back part 19. The surface 32 is inclined by approximately 45° in respect to the plane defined by the wall section 26. The surface 32 terminates at a height below the wall 29, but above a plane in which the surface section 25 is located. There the wall 32 makes a transition into a short, vertical wall section 33 extending parallel to the wall 27 and at a distance from it which is a little less than the distance between the two groove edges 12 of the groove 13 which is engaged from within the groove by surface 29 (see FIG. 1) of hook section 28. A wall 34 adjoins the lower end of the wall 33 and is located in the plane defined by the surface section 25. The surface 34 constitutes a thrust surface in a manner described hereinbelow and for this reason projects outward.

Finally, the outer edge of the thrust surface 34 makes a transition into an inclined surface 35 extending between the thrust surface 34 and the surface of the back part 19 located on the outside. Based on the surfaces described, the leg 21 is divided into a thrust part 36, a neck section 37 and a hook section 28 formed as a rib 28 pointing in a direction opposite that of the thrust part 36.

The dimensions of the different sections on the leg 21 are selected such that the hook section 28 can be inserted between the groove edges 12 into the interior of the groove 13 which is engaged from the back. In the final state the wall 29 of the hook section 28 then rests against the inside of the respective strip 9 or 11, i.e. the inner wall next to the groove edge 12, while the thrust surface 34 of the thrust section 36 rests against the outside next to the oppositely located groove edge 12. In this position the neck section 37 leads through the slit bounded by both groove edges 12, wherein the thickness of the neck section 37, i.e. the distance of the wall 27 from the wall 33 prevents the hook section 28 from falling out of the groove 13, which is engaged from behind, because of a displacement crosswise to the groove edges 12 when the thrust section 36 rests against the corresponding strip 9 or 11.

The leg 22 has a comparatively simple structure because it is slightly trapezoid in cross section and is bounded laterally by two respectively level surfaces 38 and 39 which converge in the direction away from the back part 19. The length of the leg 13, measured starting at the surface section 25, is less than the depth of the groove 16 in the panel 3.

As shown by FIG. 3, the upper retaining member 18 also has a cross-sectional form which is essentially U-shaped and has a back part 41 and two legs 42 and 43 extending in the same direction. The retaining part 13 also is a 5 to 10 cm long section of an extruded profile and thus has the same cross section over the entire length.

The leg 42 has the shape of a strip, rectangular in cross section and extending at right angles to the back part 41. On its free end this strip is provided with a hook-shaped strip 44 projecting in the direction toward the leg 43 and having an abutment surface 45 extending parallel to the back part 41 at a distance. The distance of the hook surface 45 from an interior surface 46 of the back part 41 is slightly greater than the height of the groove edge 12, i.e. the wall thickness of the strip 9 or 11.

The leg 43 consists of two sections, the section 47 adjoining the back part 41 having a rectangular cross section, while the section 48 located away from the back part 41 has a trapezoid shape. Thus the side walls 49 and 51 of the leg 43 first extend parallel to each other following the back part 41 before they are angled so that they converge toward each other at a distance from the back part 41. In the upper area adjoining the back part 41, the distance between the side walls 41 and 59 corresponds to the width of the groove 16, while the length of the leg 48 again is less than the depth of the groove 16.

Finally, a groove 52 is provided in the back part 41 for housing and supporting cables, which has the shape of a three-quarter arc in cross section.

Assembly of the wall construction for display booths, sales booths and the like takes place as follows:

First the two profiled braces 2 are fastened at the appropriate vertical distance on the columns or pillar supporting their ends at the respectively desired height. Then at least two support members 17 are suspended at a distance from each other in the groove 13, open toward the bottom and engaged from behind, of the lower profiled brace 2.

For this purpose it is inserted, as described above, with the hook section 28 at the front, from below into the respective groove 13 which is engaged from the back, for which purpose they are maintained with the back part 19 at approximately 45° in respect to the perpendicular. After inserting the hook section 28 into the lower groove 13 which is engaged from the back, the support arms are pivoted back clockwise by 45°, referring to the illustration of FIG. 1, until the thrust member rests on the outside against the underside of the profiled brace 2 with the thrust surface 34. Further pivoting of the support members 17 in a clockwise direction is prevented by the interplay of the hook surface 29 and the thrust surface 34 with the walls in the area of the groove 13 which is engaged from behind.

In the inserted state, the surface section 25 extends on the height of the underside of the profiled brace 2. The panel 3 is placed upright on the legs 22, now vertically projecting upward, of the at least two support members 17, and the leg 22 engages the groove 16. In this case the weight of the panel 3 is transmitted via the surface area 25 to the lower profiled brace 2. The leg 22 does not have to support any vertical force. Thus, independently of the depth of the groove 16, a support for the panel 3 is directly obtained so that its lower edge extends flush with the underside of the lower profiled brace 2.

After the panel 3 has been placed on the at least two lower support members 17, at least one upper retaining member 18 is suspended, with the leg 42 at the front, from the groove 13 open on the top and engaged from behind and is pushed downward until the leg 48 is inserted over its entire length in the upper groove 16 of the panel 3.

As can be seen from FIG. 3, the underside of the groove 52 forms a semi-circular bulge rising between the two legs 42 and 43. The position of this bulge has been calculated such that the free distance toward the inside of the leg 42 corresponds to the distance of the adjoining groove edge 12 from the outer surface of the side wall 4 or 5. The result of this is that, when the retaining member 18 has taken up the position shown in FIG. 1, the retaining member 18 can no longer be displaced crosswise in respect to the profiled brace 2, because the bulge formed by the groove 52 comes to rest against the outside of the profiled leg 2 while, on the other hand, the inside of the leg 42 is pressed against the adjoining groove edge 12. In this way the retaining member 18 is secured in the crosswise direction and, since the upper section 47 of the leg 43 tightly fits inside the groove 16, it is not possible to move the upper edge of the panel crosswise in respect to the respective profiled brace 2. Fastening free of play is also assured here because of the corresponding size of the leg 22 of the lower support member 17 in relation to the width of the groove 16. The crosswise displacement of the lower support member 17 is prevented by the neck section 37.

Because the distance between the legs 42 and 43 of the upper retaining member 18 is the same as the distance between the legs 21 and 22 of the lower support member 17, the panel 3 has respectively the same distance from the adjoining profiled brace 2 on the top as well as on the bottom.

If the panels 3 greatly extend upward, it is possible that with pressure on the panel 3 the upper retaining member 18 is pushed out of the groove 16 of the panel 3, because the rounded outer contour of the groove 52 rises upward at the adjoining edge of the profiled brace 2 on account of the pressure exerted vertically in respect to the profiled brace 2, for which reason the leg 43 is released from the groove 16. To prevent this, it is possible to form an additional strip 54 on the outer wall of the groove 52, as indicated by dashed lines in FIG. 3. This strip 54 extends tangentially from the side wall of the groove 52, namely at the lowest point in accordance with FIG. 3, and points in the direction toward the leg 42. In this way the strip 54 has the greatest distance from the inside 46 of the back part 41 in respect to which it extends parallel relative to the cross section. The length of the strip 54, measured parallel to the extension of the back part 41 in cross section, has been selected such that a straight line on the free end of the strip 54 leads through the neck area, at which the outer surface of the groove 52 begins to rise above the inside 46. In this way it is achieved that with the retaining member 18 inserted, the strip 54 rests with its free end, referring to FIG. 1, against the side wall 5 of the upper profiled brace 2, and this at a clear distance from the rounded upper edge at which the side wall 5 makes a transition into the strip 11, when a force is exerted on the leg 43 perpendicularly to the long axis of the profiled brace 2. In this way it is prevented that the transmitted pressure force tries to pivot the retaining member 18 upward counterclockwise, again making reference to FIG. 1.

A very robust thrust member with simultaneously reduced material requirements results when it is formed by a rib which is triangular in cross section.

Bursting of the wall panel because of the leg engaging the groove is assuredly avoided under any circumstances if the back part of the support member is provided with a support shoulder which adjoins the respective leg and on which the wall panel is seated. In this case the leg seated in the groove of the wall panel only needs to absorb the considerably lesser crosswise forces and does not have to bear the weight of the panel. In addition, in this way the position of the panel is not determined by the depth of the groove cut into the edge area of the wall panel.

It is of particular advantage when the support surfaces of this shoulder are at the same height as the thrust element, because in this way the size of the wall panel is equal to the distance of the underside of the lower brace from the top side of the upper brace. Any allowances, which might result in measuring and cutting errors, are eliminated.

Placement of the wall panel on the support member is simplified if the leg engaging the groove is approximately trapezoid in cross section. By means of this it is additionally avoided that tilting of the panel, which is unavoidable during assembly, tears the groove open at the side.

To maintain the panel in the vertical position it is practical that the upper brace is assigned its own retaining member, which has a cross-sectional shape different from that of the support member. Because it does not have to transmit any moments to the brace and only transmits crosswise forces, it can also be designed to be considerably simpler. However, the retaining member is also preferably made of a section of an extruded profile, essentially having a U-shaped cross section with a back part and two legs. In this case One of the legs is seated in the upwardly open groove, which is engaged from the back, of the upper cross brace, while the other leg engages an appropriate groove of the wall panel.

A further groove is advantageously formed in the upper retaining member, by means of which it is possible to maintain or guide a cable or the like, hidden behind the wall panel.

If the leg seated in the groove of the brace has a thickness corresponding to half the width of the groove, it is possible to suspend two retaining members pointing in opposite directions directly at the same place, so that it is possible to install wall panels on both sides of the brace without it being necessary to offset the retaining members in respect to each other in the longitudinal direction of the brace.

Various changes and modifications may be made, and features described in connection with any one of the embodiments may be used with any of the others, within the scope of the inventive concept.

I claim:

1. A wall construction for display booths, sales booths or the like, which comprises:

at least two braces (2) extending parallel and one spaced above the other, at least the lower one having a U-shaped groove (13) with inturned edges (12) to permit engagement from behind;

a panel (3) supported on the braces (2) and extending over the space between, and covering, the braces, which panel (3) is formed with a panel groove (16) extending parallel to the respective brace (2) at least in its lower edge (14, 15) extending parallel to the braces (2);

a unitary support member (17), being essentially U-shaped in plan view, for supporting the panel (3) and connecting the panel to the lower brace (2), said member (17) having a back part (19) and two legs (21, 22) extending longitudinally of the support member (17) and parallel to each other, wherein, with the panel (3) secured on the lower brace (3), one (21) of the legs (21, 22) engages the groove (13) of the lower brace (2) and the other (22) of the legs (21, 22) engages the groove (16) in the lower edge area of the panel (3);

a hook element (28) formed on said one leg (21) cooperating with the brace (2), and that, when mounted, engages one of the inturned edges of the groove (13), the hook facing toward the other leg (22);

an abutment portion (36) formed on said one leg (21) extending in the opposite direction as the hook element (28) and which, when the hook element (28) is inserted in the groove (13) of the lower brace, abuts at the lower brace (2) outside of the other inturned edge of the groove (13);

wherein the abutment portion (36) is offset in height with respect to the hook element (28) in accordance with the wall thickness of the groove (13);

and wherein the hook element (28) has a cross section which permits, when the leg (21) is pivoted, introducing the hook element (28) into the groove (13) over its edges (12).

2. The wall construction of claim 1, characterized in that the abutment portion (36) is essentially triangular in cross section, wherein an edge which most closely adjoins the hook section (28) extends parallel to the normal line on the panel (3).

3. The wall construction of claim 1, characterized in that the back part (19) has a flat support shoulder (25) located one an opposite sides of the hook element in one plane with a surface (34) of the abutment portion (36) resting against the brace (2).

4. The wall construction of claim 1, characterized in that the leg (22) which can be inserted into the groove (16) of the panel has an approximately trapezoidal cross-sectional shape, and having edges (38, 39) which converge in the direction away from the back part (19).

5. The wall construction of claim 1, characterized in that at least one upper brace (2) extends horizontally, at least one retaining member (18) is associated with said upper brace (2) for securing an upper portion of the panel (3) in upright position on the upper brace (2).

6. The wall of claim 5, characterized in that the retaining member (18) is essentially U-shaped in plan view and has a back part (41), from which two legs (42, 43) extend in the same direction;

and that one of the legs (42) is secured to the upper brace (2) and the other leg (43) engages a panel groove (16) at an upper edge of the panel (3).

7. The wall construction of claim 6, characterized in that the leg of the retaining member (42) which can be inserted into the groove (13) of the upper brace (2) has a projection (44) pointing in the direction toward the other leg (43) and a distance of the projection from the back part (41) is equal to the wall width in the area of the groove edge (12) of the groove (13) of the upper brace (2).

8. The wall construction of claim 7, characterized in that the projection (44) is formed by a rib (44) extending over the length of the retaining member (18).

9. The wall construction of claim 8, characterized in that the rib (44) is triangular in cross section, wherein the edge (45) facing the back part (41) extends approximately parallel with the back part (41).

10. The wall construction of claim 6, characterized in that the leg (43) of the upper brace seated in the panel groove (16) has a cross-sectional profile which is approximately trapezoidal and converges in the direction away from the back part (41).

11. The wall construction of claim 10, characterized in that the retaining member has a section (47) disposed between the back part (41) and a lower part (48) of the leg (43), which is trapezoidal in cross section, is bounded by two walls which are parallel to each other.

12. The wall construction of claim 11, characterized in that the thickness of the section (47) bounded by the parallel walls is approximately equal to the width of the panel groove (16) in the upper edge (14) of the panel (3).

13. The wall construction of claim 6, characterized in that the retaining member back part (41) contains a back groove (52) extending over the length of the retaining member (18) and parallel to the legs (42, 43).

14. The wall construction of claim 13, characterized in that the back groove (52) has a cross section approximately in the shape of a three-quarter arc and has a groove slit which opens, in relation to the back part (41), in the direction opposite to that of the legs (42, 43).

15. The wall construction of claim 6, characterized in that the width of the leg (42) of the retaining member (18) which can be inserted into the groove (13) of the brace (2) is at most half that of the distance between the groove edges (12).

* * * * *